US007125319B2

(12) United States Patent
Brown et al.

(10) Patent No.: US 7,125,319 B2
(45) Date of Patent: Oct. 24, 2006

(54) APPARATUS AND METHOD FOR GRINDING AND/OR POLISHING AN EDGE OF A GLASS SHEET

(75) Inventors: James W. Brown, Painted Post, NY (US); Clive D. Gierbolini, Painted Post, NY (US); Toshihiko Ono, Fukuroi (JP); Babak R. Raj, Elmira, NY (US); Robert G. Schaeffler, Pine City, NY (US)

(73) Assignee: Corning Incorporated, Corning, NY (US)

( * ) Notice: Subject to any disclaimer, the term of this patent is extended or adjusted under 35 U.S.C. 154(b) by 90 days.

(21) Appl. No.: 10/694,693

(22) Filed: Oct. 27, 2003

(65) Prior Publication Data

US 2005/0090189 A1 Apr. 28, 2005

(51) Int. Cl.
*B24B 1/00* (2006.01)

(52) U.S. Cl. ..... 451/44; 451/365; 451/388

(58) Field of Classification Search ..... 451/44, 451/365, 384, 388, 390, 451, 457, 460
See application file for complete search history.

(56) References Cited

U.S. PATENT DOCUMENTS

| | | | | |
|---|---|---|---|---|
| 3,332,759 | A * | 7/1967 | McMaster et al. | 65/25.2 |
| 3,338,696 | A | 8/1967 | Dockerty | 65/145 |
| 3,682,609 | A | 8/1972 | Dockerty | 65/83 |
| 3,841,027 | A | 10/1974 | Bando | 51/110 |
| 3,889,801 | A | 6/1975 | Boyer | 198/184 |
| 3,991,538 | A | 11/1976 | Finn et al. | 53/21 |
| RE29,097 | E | 1/1977 | Bando | 51/110 |
| 4,079,551 | A | 3/1978 | Bando | 51/110 |
| 4,493,167 | A | 1/1985 | Bovone | 51/110 |
| 4,578,103 | A | 3/1986 | Fackelman | 65/182.2 |
| 4,660,327 | A * | 4/1987 | Bando | 451/261 |
| 4,716,686 | A | 1/1988 | Lisec | |
| 4,843,764 | A * | 7/1989 | Bando | 451/260 |
| 5,028,182 | A | 7/1991 | Park | 409/225 |
| 5,040,342 | A * | 8/1991 | McGuire et al. | 451/44 |

(Continued)

FOREIGN PATENT DOCUMENTS

EP 1314513 A2 5/2003

OTHER PUBLICATIONS

A.H. Slocum, *Precision Machine Design*, Society of Manufacturing Engineers, Prentice Hall, New Jersey (1992), Chapter 9, pp. 551-639.

(Continued)

*Primary Examiner*—M. Rachuba
(74) *Attorney, Agent, or Firm*—Thomas R. Beall; Joanne N. Pappas

(57) ABSTRACT

An apparatus and method are described herein which help prevent particles and other contaminants that are generated when an edge of a glass sheet is processed from contaminating or damaging the glass sheet. The apparatus includes an encapsulation device and a processing device. The encapsulation device is capable of supporting two surfaces of a glass sheet. And, the processing device is capable of processing (e.g., cutting, scribing, grinding or polishing) the edge that is adjacent to the supported two surfaces of the glass sheet which are located on a first side of the encapsulation device. The encapsulation device is also capable of substantially preventing particles and other contaminants that are generated when the processing device processes the edge of the glass sheet from reaching the two surfaces of the glass sheet which are located on a second side of the encapsulation device.

11 Claims, 6 Drawing Sheets

U.S. PATENT DOCUMENTS

| | | | | |
|---|---|---|---|---|
| 5,197,937 | A | 3/1993 | Dalrymple | 493/167 |
| 5,487,629 | A * | 1/1996 | Watanabe | 409/137 |
| 5,693,167 | A | 12/1997 | Cahill et al. | 156/205 |
| 5,928,060 | A * | 7/1999 | Miller | 451/5 |
| 6,027,440 | A | 2/2000 | Roth | 493/436 |
| 6,099,385 | A * | 8/2000 | Stock et al. | 451/8 |
| 6,196,902 | B1 * | 3/2001 | Gazca-Ortiz et al. | 451/242 |
| 6,231,429 | B1 | 5/2001 | Lisec | |
| 6,264,538 | B1 * | 7/2001 | Rettig | 451/184 |
| 6,273,785 | B1 * | 8/2001 | Mulroy et al. | 451/28 |
| 6,325,704 | B1 | 12/2001 | Brown et al. | 451/44 |
| 6,428,390 | B1 | 8/2002 | Clark et al. | 451/11 |
| 6,450,865 | B1 * | 9/2002 | Mulroy et al. | 451/49 |
| 2002/0019201 | A1 * | 2/2002 | Bushell | 451/44 |

OTHER PUBLICATIONS

Glass Machinery Engineering's Product Brochure Entitled "MB, MB-PN Double Edgers" 19 pages (published prior to Jun. 29, 1999).

Slocum, A.H. "Precision Machine Design" Society of Manufacturing Engineers, Prentice Hall, New Jersey, chapter 9 (1992).

Bando's Product Brochure Entitled "Automatic Glass Double Edge Machine" 4 pages (published prior to Jun. 29, 1999).

Bando's Product Brochure Entitled "Double Edging Machine", 9 pages, 1986.

* cited by examiner

APPARATUS AND METHOD FOR GRINDING AND/OR POLISHING AN EDGE OF A GLASS SHEET

BACKGROUND OF THE INVENTION

1. Field of the Invention

The present invention relates to an apparatus and method for processing an edge of a glass sheet. More particularly, the present invention relates to an apparatus and method for cutting, scribing, grinding or polishing an edge of a glass sheet that can be used in a flat panel display.

2. Description of Related Art

Processing glass sheets that require a high quality surface finish like the ones used in flat panel displays, typically involves cutting the glass sheet into a desired shape and then grinding and/or polishing the edges of the cut glass sheet to remove any sharp corners. Today the grinding and polishing steps are usually carried out on an apparatus known as a double edger or double edging machine. Such double edging machines are known and available from Bando Kiko Co., Ltd., Mitsubishi Heavy Industries, Fukuyama Co., and Glass Machinery Engineering.

During the grinding and polishing of the edges of a glass sheet using a double edging machine, the glass sheet is typically sandwiched between two neoprene or rubber belts. The belts contact both surfaces of the glass sheet and cooperate to hold the glass sheet in place while the edges of the glass sheet are ground or polished by an abrasive grinding wheel. The belts also transport the glass sheet through a feeding section of the machine, a grinding or polishing section of the machine, and an end section of the machine.

This method of gripping, processing and conveying a glass sheet using a double edging machine has several disadvantages. First, the particles generated during edge finishing can be a major source of contamination on the surfaces of the glass sheet. Thus, the glass sheet requires extensive washing and drying at the end of the finishing process to clean and wash off the generated particles. Of course, the additional steps of washing and drying at the end of the finishing process impacts the original cost for the finishing line and increases the cost of manufacturing. Secondly, the particles and chips caught between the belts and the glass sheet can severely damage the surfaces of the glass sheet. Sometimes this damage can be the cause of a break source during subsequent processing steps and result in poor process yields due to a reduced number of selects that can be shipped to a customer.

To address these concerns, the surfaces of the glass sheet are currently protected by a plastic film to help prevent damage and contamination. But, if the source of contamination can be eliminated/minimized, then the plastic film is not needed and that would reduce the cost and complexity of the finishing process. Minimizing surface scratches would also help the glass manufacturer meet the customer's stringent demands and challenging specifications. Moreover, minimizing the generated particle levels would reduce the load on the washing equipment downstream. Accordingly, there is a need for an apparatus and method that helps prevent particles and other contaminants that are generated during edge finishing from contaminating or damaging the two surfaces of a glass sheet. This need and other needs are satisfied by the apparatus and method of the present invention.

BRIEF DESCRIPTION OF THE INVENTION

The present invention includes an apparatus and method that helps prevent particles and other contaminants that are generated when an edge of a glass sheet is processed from contaminating or damaging the glass sheet. The apparatus includes an encapsulation device and a processing device. The encapsulation device is capable of supporting two surfaces of a glass sheet. And, the processing device is capable of processing (e.g., cutting, scribing, grinding or polishing) the edge that is adjacent to the supported two surfaces of the glass sheet which are located on a first side of the encapsulation device. The encapsulation device is also capable of substantially preventing particles and other contaminants that are generated when the processing device processes the edge of the glass sheet from reaching the two surfaces of the glass sheet which are located on a second side of the encapsulation device.

BRIEF DESCRIPTION OF THE DRAWINGS

A more complete understanding of the present invention may be had by reference to the following detailed description when taken in conjunction with the accompanying drawings wherein.

DETAILED DESCRIPTION OF THE DRAWINGS

Referring to FIGS. 1–7, there are disclosed in accordance with the present invention two embodiments of an apparatus 100 and 400 and a preferred method 700 for processing an edge of a glass sheet 120 and 420. Although each apparatus 100 and 400 is described herein as being used to grind and polish an edge of a glass sheet, it should be understood that each apparatus 100 and 400 can also be used to process other types of materials such as plexi-glass™ or metal. Accordingly, the apparatus 100 and 400 and method 700 of the present invention should not be construed in a limited manner.

Figure 1:
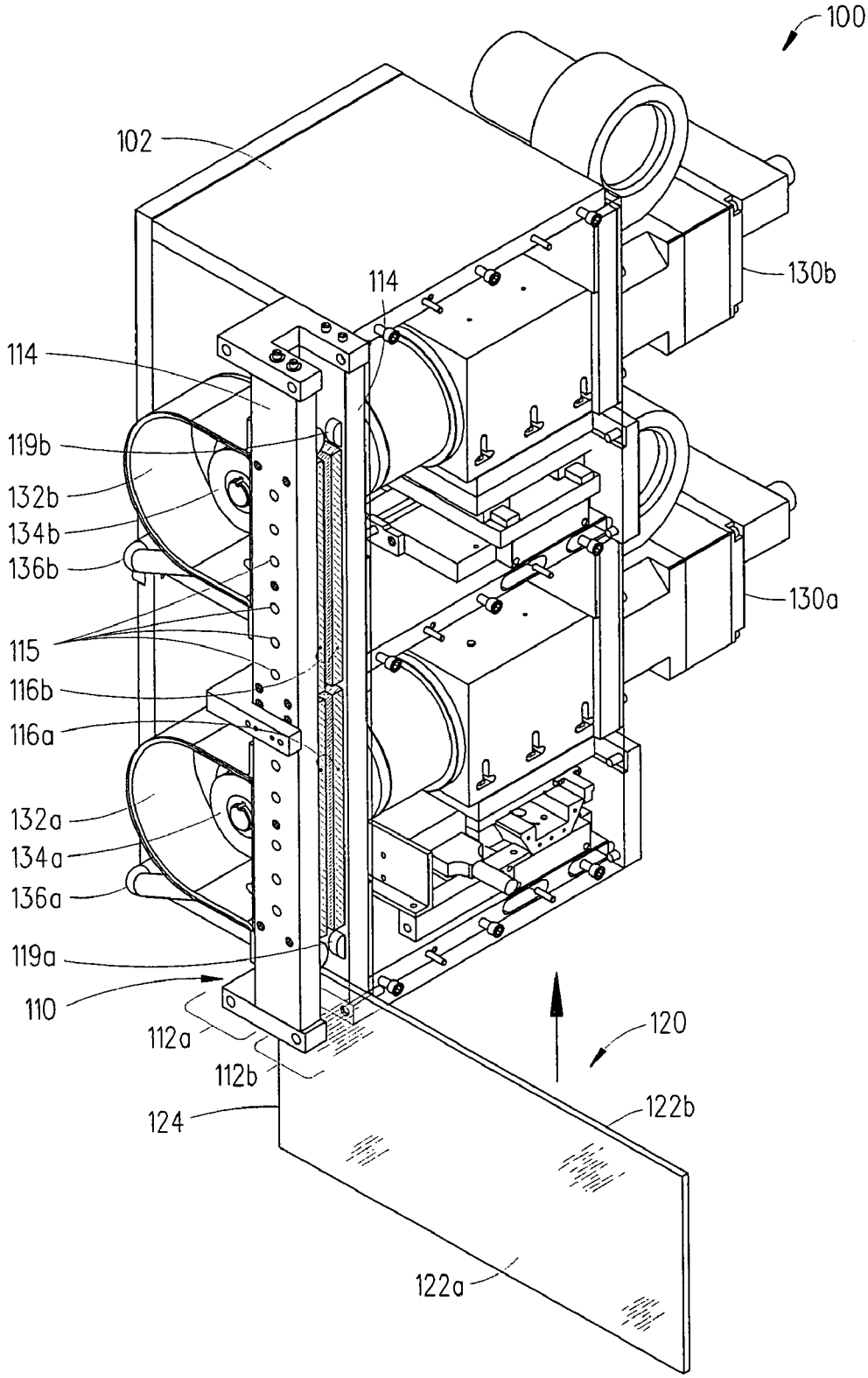
FIG. 1 is a perspective view of an apparatus in accordance with a first embodiment of the present invention.
Figure 2:
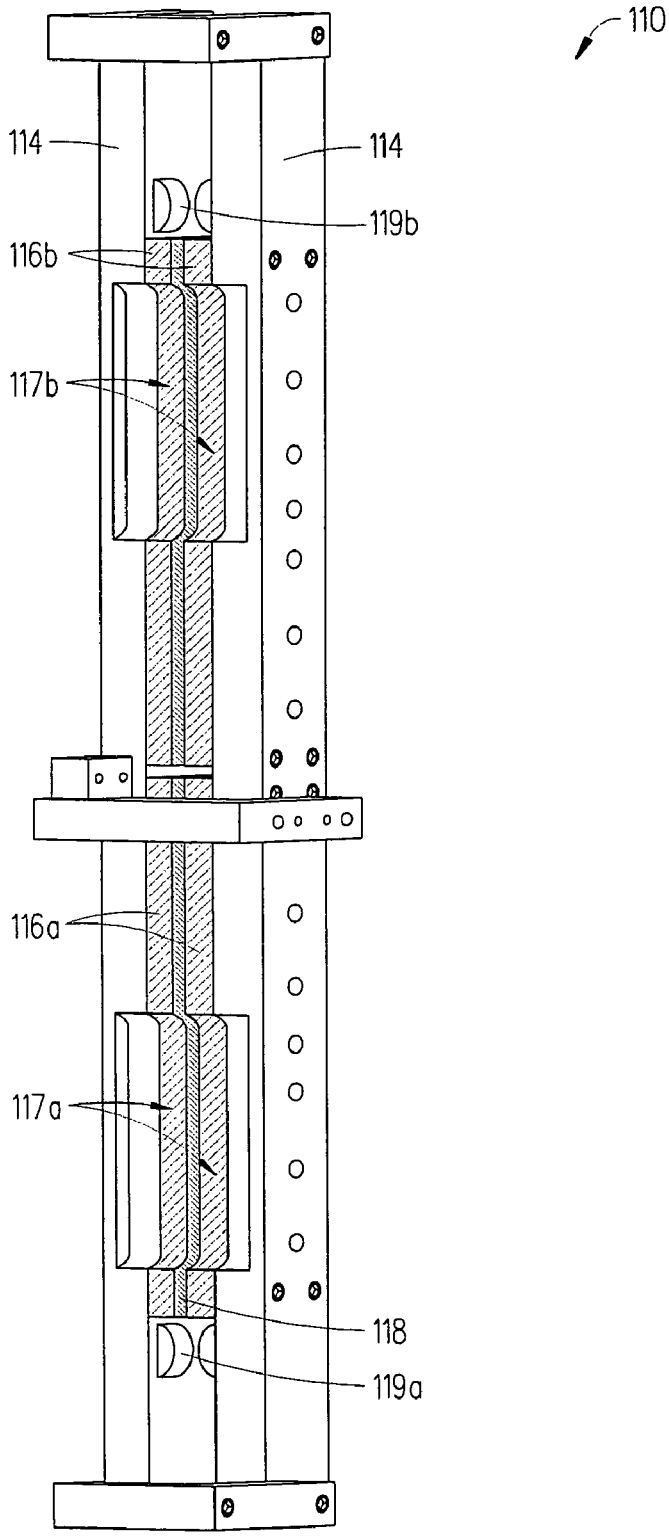
FIG. 2 is a perspective view of an encapsulation device that is incorporated within the apparatus shown in FIG. 1.
Figure 3:
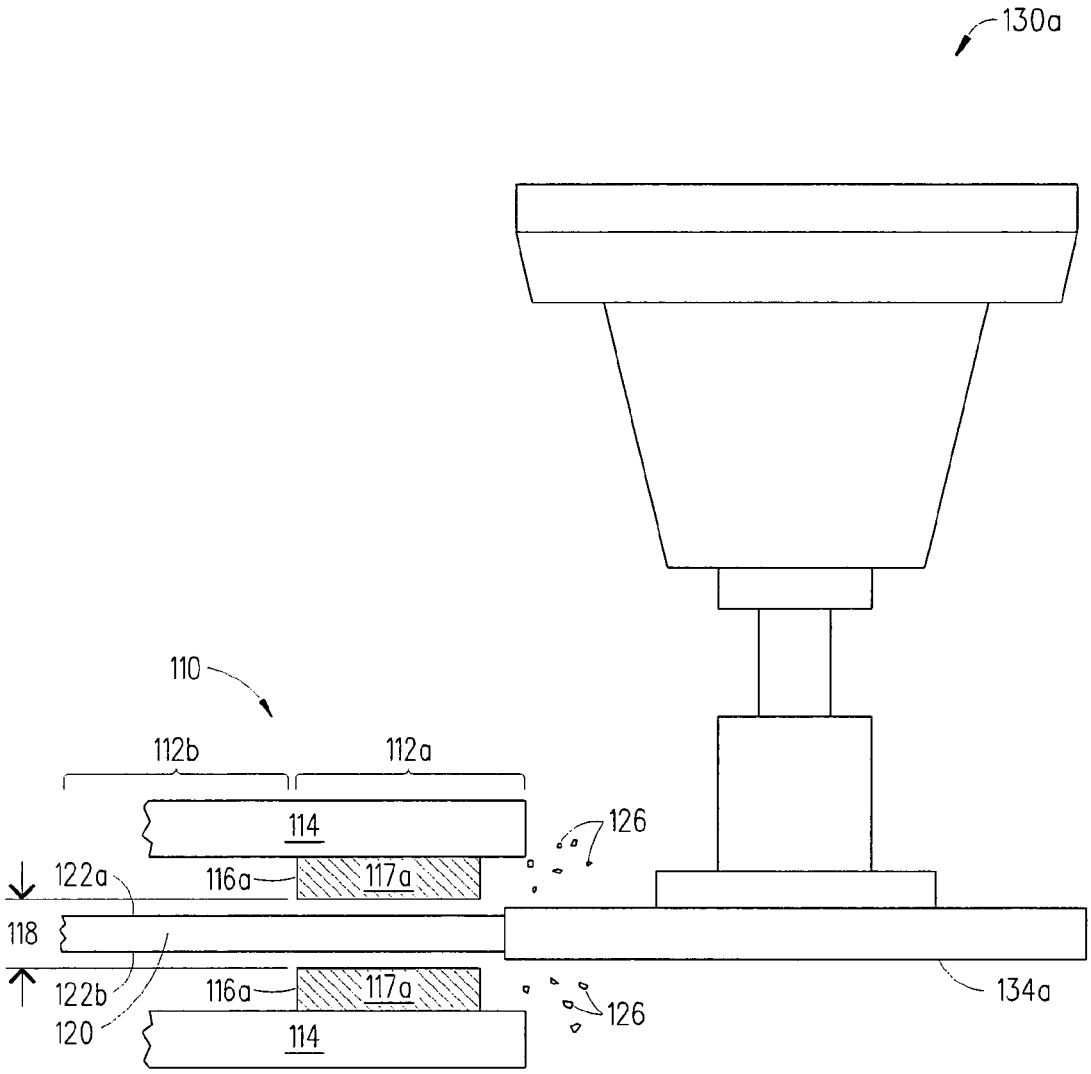
FIG. 3 is a side view of the encapsulation device and a processing device both of which are incorporated within the apparatus shown in FIG. 1.

Referring to FIGS. 1–3, there are shown several different views of the apparatus 100 in accordance with a first embodiment of the present invention. The apparatus 100 includes a housing 102 that supports an encapsulation device 110 and one or more processing devices 130*a* and 130*b* (two shown). The encapsulation device 110 is capable of supporting two surfaces 122*a* and 122*b* of a glass sheet 120. And, the processing devices 130*a* and 130*b* (e.g., grinding device 130*a* and polishing device 130*b*) are capable of processing (e.g., grinding or polishing) an edge 124 that is adjacent to the supported two surfaces 122*a* and 122*b* of the glass sheet 120 which is located on a first side 112*a* of the encapsulation device 110 (see FIG. 3). The encapsulation device 110 is also capable of substantially preventing the particles and other contaminants 126 that are generated when the processing devices 130*a* and 130*b* processes the edge 124 of the glass sheet 120 from reaching the two surfaces 122*a* and 122*b* of the glass sheet 120 located on a second side 112*b* of the encapsulation device 110 (see FIG. 3). The glass sheet 120 is shown in FIG. 1 as being moved across a stationary apparatus 100. Alternatively, the apparatus 100 can be moved while the glass sheet 120 is held in place. A more detailed description about the encapsulation device 110 and the processing devices 130*a* and 130*b* are provided below with respect to FIGS. 2–3.

As shown in FIGS. 2–3, the encapsulation device 110 includes a manifold support plate 114 and one or more pairs of porous plates 116*a* and 116*b* (two pairs of porous plates 116*a* and 116*b* are shown). The porous plates 116*a* and 116*b* are supported by the manifold support plate 114 and pressurized by air received from the manifold support plate 114 which flows through the porous plates 116*a* and 116*b* and supports the two surfaces 122*a* and 122*b* of the glass sheet 120 within a gap 118 between each pair of porous plates 116*a* and 116*b* (see FIG. 3). The manifold support plate 114 receives the pressurized air into one or more openings 115 from an air source (not shown). The pressurized air emitted from the porous plates 116*a* and 116*b* prevents the particles and other contaminants 126 that are generated when the processing device 130*a* and 130*b* processes the edge 124 of the glass sheet 120 from reaching the portion of the glass sheet 120 located on the second side 112*b* of the encapsulation device 110 (see FIG. 3). The encapsulation device 110 further includes one or more pairs of guide wheels 119*a* and 119*b* that are capable of guiding the two surfaces 122*a* and 122*b* of the glass sheet 120 into the gap 118 between the pairs of porous plates 116*a* and 116*b* (see FIGS. 1 and 2).

The processing device 130*a* and 130*b* includes a shroud box 132*a* and 132*b* in which the particles and other contaminants 126 are contained and evacuated from when a finishing device 134 (e.g., grinder 134*a*, polisher 134*b*) processes the edge 124 of the glass sheet 120 (see FIGS. 1 and 3). The processing device 130*a* and 130*b* also includes a vacuum line 136*a* and 136*b* which is connected to the shroud box 132*a* and 132*b* at a strategic location to evacuate the particles and other contaminants 126 (see FIG. 1). The vacuum line 136*a* and 136*b* is also used to evacuate water and other lubricants which aid in the grinding and/or polishing of the edge 124 of the glass sheet 120.

Each pair of porous plates 116*a* and 116*b* are located in close proximity to where the particles and other contaminants 126 are generated by the turning of the finishing devices 134*a* and 134*b* within the processing devices 130*a* and 130*b*. The two porous plates 117*a* and 117*b* in each pair of porous plates 116*a* and 116*b* are held parallel to each other by the manifold support plate 114 (see FIG. 2). The manifold support plate 114 not only holds and allows a change in the positioning of the individual porous plates 117*a* and 117*b*, but it also ensures the even distribution of the flow of pressurized air across the length of the gap 118 between each pair of porous plates 116*a* and 116*b*. The size of the gap 118 associated with each pair of porous plates 116*a* and 116*b* can be accurately controlled. The edge 124 of the glass sheet 120 is preferably moved through this gap 118 without contacting the porous plates 116*a* and 116*b*. And, the porous plates 116*a* and 116*b* are positioned at such a distance to allow the edge 124 of the glass sheet 120 to slightly stick out to enable the finishing process to take place (see FIG. 3). In general, the amount that the edge 124 of the glass sheet 120 is left exposed on the first side 112*a* of the encapsulation device 110 should be minimized. For example in the case of grinding, the type and the depth of the groove in the wheel 134*a* used in the grinding device 130*a* dictates this distance. As described above, the porous plates 116*a* and 116*b* are pressurized by air. The resulting high pressure and the airflow that is created in the small gap 118 between the porous plates 116*a* and 116*b* and on the two surfaces 122*a* and 122*b* of glass sheet 120 deflects and rejects the particles and contaminants 126 from reaching the glass sheet 120 located on the second side 112*b* of the encapsulation device 110 (see FIG. 3).

Below are detailed descriptions about experiments conducted by the inventors in which they tested experimental apparatuses 100. The experimental apparatuses 100 had the following characteristics:

Two porous aluminum plates 116*a*—10.25×2.4×0.75 inches.

Water flow—2 liters/min.

Exhaust vacuum—Craftsman 6.5 h.p. shop vacuum with ~6 ft. hose.

Air—0.75" copper into filter regulator. 0.5" copper out of regulator to ⅜" hose.

⅜" T one line to each of the two porous plates (~4 feet long).

The ⅜" lines were plumbed into ¼" swage lock stainless steel manifold that has four ports going into each porous plate 116*a*.

The grinding wheel 134*a* was on and running at a predetermined speed during these experiments.

All testing was done using a CNC multi-axis machine in a manual mode which moved the porous plates 116*a* over the glass sheet 120.

Two conditions were tested:

(1) moving the porous plates 116*a* from left to right 10" into the glass sheet 120 and then back off; and (2) starting at the right side and off the glass sheet 120 and then running the porous plates 116*a* the full length of the glass sheet 120.

The initial experiments were attempted with the glass sheet 120 positioned with 10 mm's of exposed glass edge 124 (between the face of the porous plates 116*a* and the grinding wheel 134*a*). With this setup water was spraying out of a slot in the shroud box 132*a* that the glass sheet 120 passed through.

It was learned during these experiments that the preferred shroud box 132*a* design enables the edge 124 to be entirely covered by the porous plates 116*a* and it was decided to move the edge 124 of the glass sheet 120 back into the porous plates 116*a* so the edge 124 of the glass sheet 120 was even with the edge of the porous plates 116*a* (see FIGS. 2 and 3). This enabled the shroud box 132*a* to be sealed to the porous plates 116*a* which helped prevent the water from spraying out.

The results of the tests conducted on the experimental apparatus 100 are provided below in TABLE #1:

TABLE #1

| Aluminum Porous Plates | 100 psi | 80 psi | 70 psi | 60 psi | 50 psi | 40 psi | 30 psi |
|---|---|---|---|---|---|---|---|
| Distance to glass sheet (mm) | | | | | | | |
| 0.5 | X | OK | OK | OK | NG | NG | X |
| 0.75 | *OK | **OK | **OK | marginal | NG | NG | X |
| 0.85 | marginal | marginal | ***NG | X | X | X | X |
| 1 | NG | NG | NG | X | X | X | X |
| Plastic Coated Aluminum Porous Plates | | | | | | | |
| 0.5 | X | VG | VG | VG | VG | X | X |
| 0.75 | X | OK | OK | OK | OK | X | X |
| 1 | X | X | X | VG | OK | OK | OK |
| 1.25 | X | X | X | VG | OK | X | X |

The aluminum porous plates had a porosity of ~400 micron.
The plastic coated aluminum porous plates has a porous poly propylene plastic face with a porosity of ~125–175 micron.
OK - No water beyond 10 mm quality area.
NG = Water spots beyond 10 mm quality area.
X = Not tested.
*Few drops only at edge.
**Droplets seen 1–2 mm from edge.
***Droplets 5–6 mm from edge but some outside quality area.

After grinding the edge 124 of the glass sheet 120 it was immediately inspected using a high intensity inspection light. Several attempts to make the water spots show up better were made like putting food coloring in the water or using a black light with the hope that any contamination would glow in this light. However, it was found that using an Xenon lamp and looking at the surface of the glass with the bright light reflecting off the surface showed the water spots best. Following is a list of definitions related to the acronyms "OK" and "VG" used in TABLE 1:

If there were no water spots beyond the 10 mm quality area it was considered OK. Most of the "OK" results had some water spots less than 6 mm in from the edge 124.

If there were only a few drops of water right at the edge 124 it was considered Very Good "VG".

It should be noted that on a couple occasions the air was not on to the porous plates 116*a* and the glass sheet 120, although there was water beyond the 10 mm mark on the glass sheet 120 it was not covered with water and the water never passed through the width of the porous plates 116*a*.

Referring to TABLE #1, it can be seen that the operating range for the aluminum porous plates 116*a* is 0.85 mm at 80 psi to 0.5 mm with 60 psi. And, the operating range for plastic coated aluminum porous plates 116*a* is 1.25 mm at 50 psi to 0.5 mm at <50 psi. Unfortunately the data indicated in TABLE #1 was obtained when the swage lock nuts holding the top porous plate were only finger tight. Leakage at these fittings could have affected the airflow and less pressure could have been needed and a greater distance might have been achievable if these fittings had been tight. Therefore, this data is definitely worse case.

In addition to the results shown in TABLE #1, there was found to be an advantage to coating the porous plates 116*a* with a porous plastic. If the glass sheet 120 touches the porous plastic coated plates it will be less likely to be scratched. And, if the edge 124 of the glass sheet 120 cuts into the porous plastic on the plates it can be removed and replaced but if the edge 124 cuts into the aluminum porous plates 116*a* the surface would be gouged and would need to be resurfaced (machined) or possibly replaced. Replacing the porous plastic is much quicker and less expensive. Since the porous plastic is hydrophobic this is also an advantage.

Figure 4:
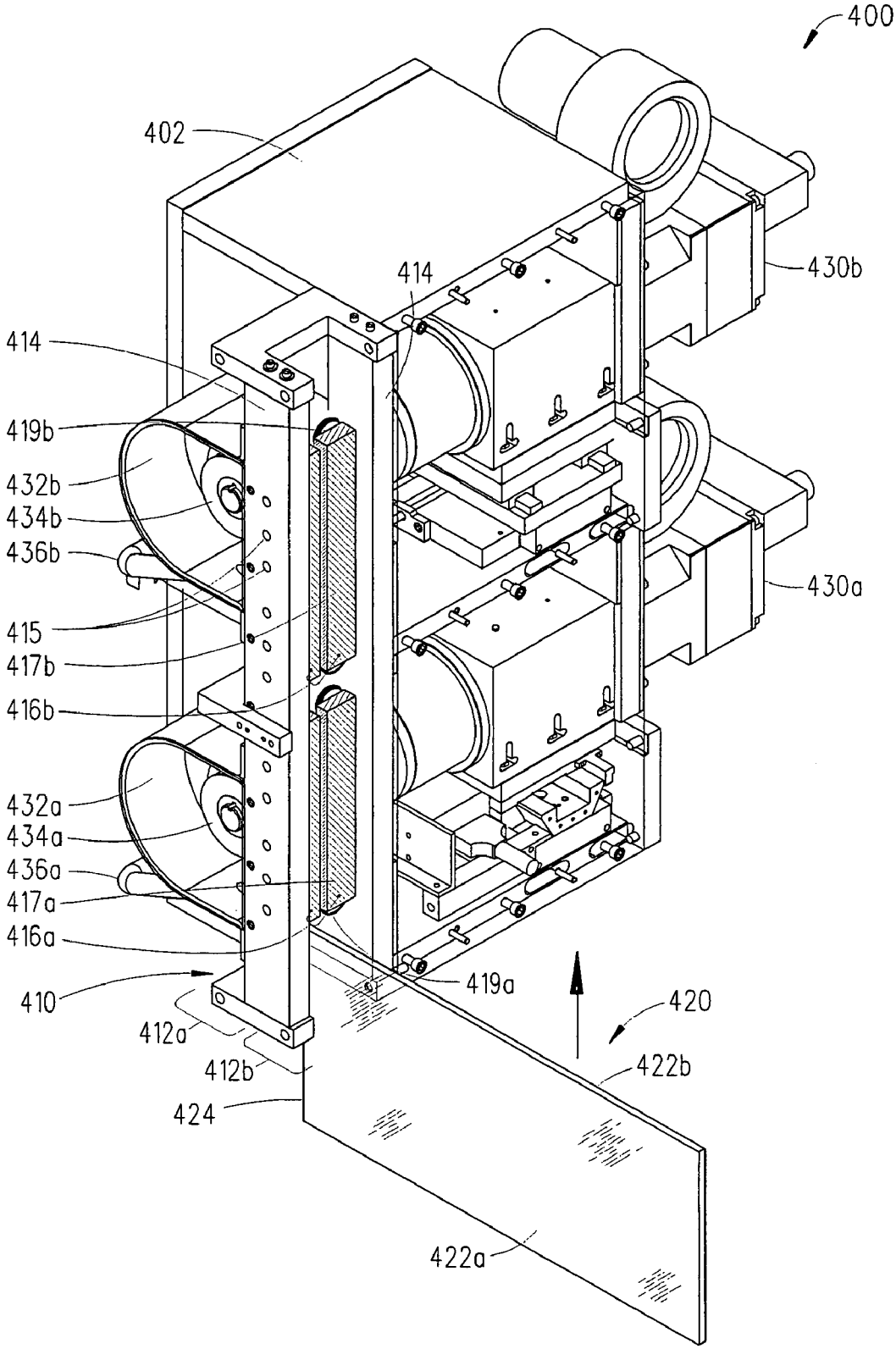
FIG. 4 is a perspective view of an apparatus in accordance with a second embodiment of the present invention.
Figure 5:
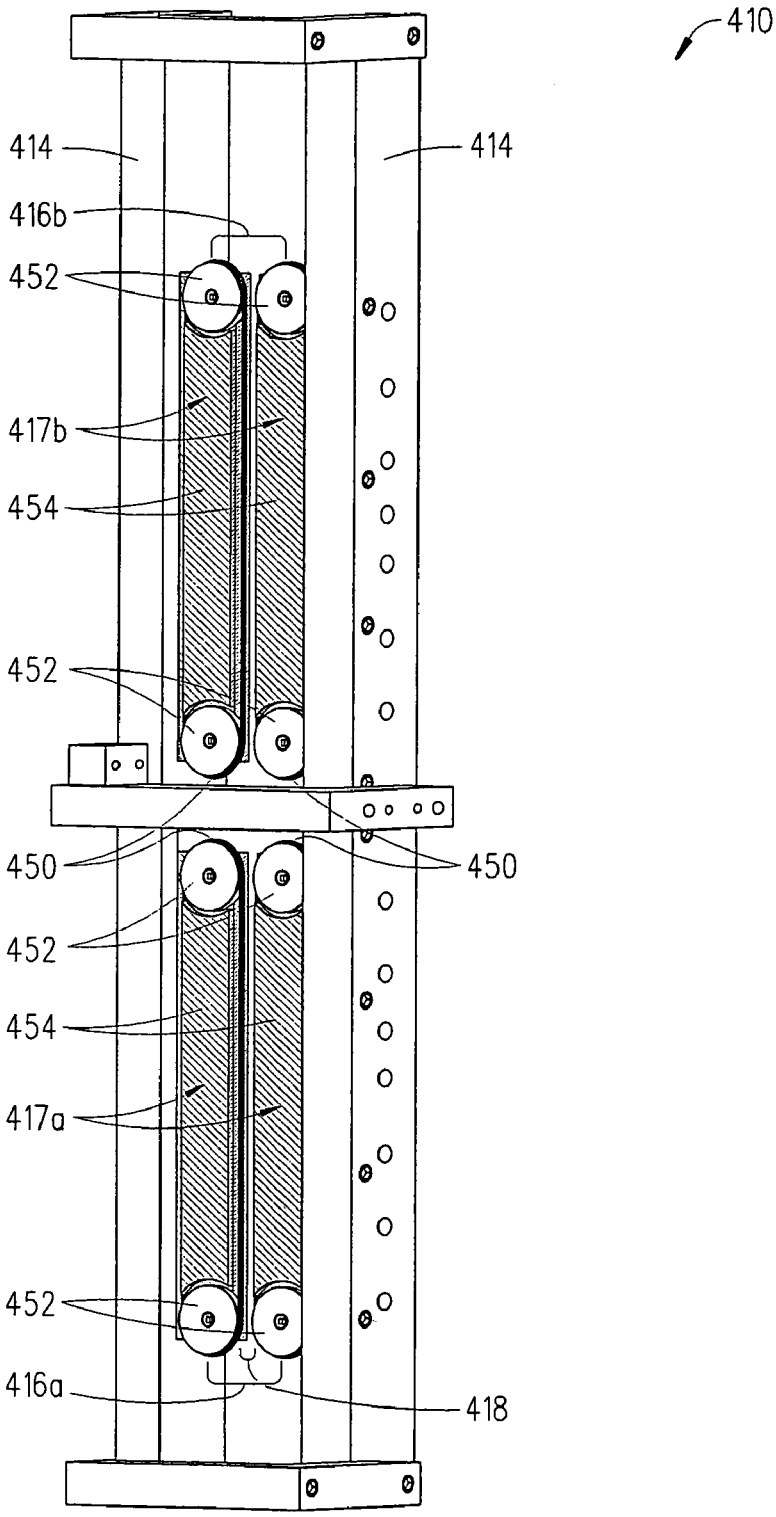
FIG. 5 is a perspective view of an encapsulation device incorporated within the apparatus shown in FIG. 4.
Figure 6:
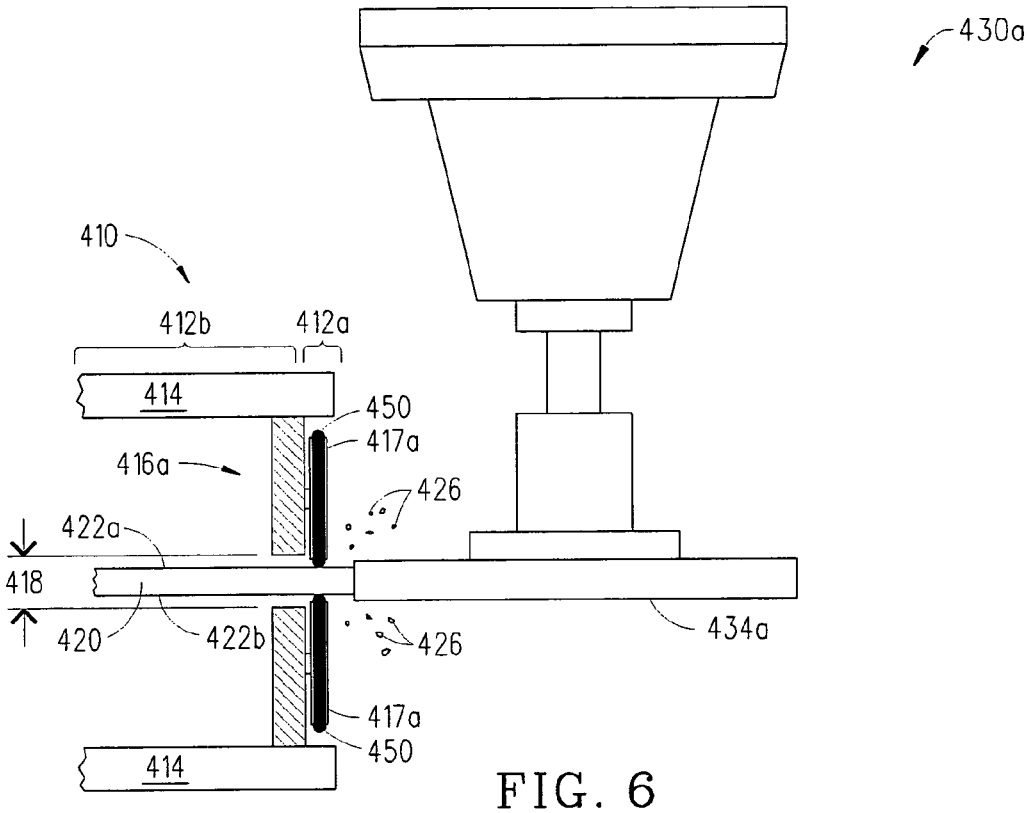
FIG. 6 is a side view of the encapsulation device and a processing device both of which are incorporated within the apparatus shown in FIG. 4.

Referring to FIGS. 4–6, there are shown several different views of the apparatus 400 in accordance with a second embodiment of the present invention. The apparatus 400 includes a housing 402 that supports an encapsulation device 410 and one or more processing devices 430*a* and 430*b* (two shown). The encapsulation device 410 is capable of supporting two surfaces 422*a* and 422*b* of a glass sheet 420. And, the processing devices 430*a* and 430*b* (e.g., grinding device 430*a* and polishing device 430*b*) are capable of processing (e.g., grinding or polishing) an edge 424 that is adjacent to the supported two surfaces 422*a* and 422*b* of the glass sheet 420 which is located on a first side 412*a* of the encapsulation device 410 (see FIG. 6). The encapsulation device 410 is capable of substantially preventing the particles and other contaminants 426 that are generated when the processing devices 430*a* and 430*b* processes the edge 424 of the glass sheet 420 from reaching the two surfaces 422*a* and 422*b* of the glass sheet 420 located on a second side 412*b* of the encapsulation device 410. The glass sheet 420 is shown in FIG. 4 as being moved across a stationary apparatus 400. Alternatively, the apparatus 400 can be moved while the glass sheet 420 is held in place. A more detailed description about the encapsulation device 410 and the processing devices 430*a* and 430*b* are provided below with respect to FIGS. 5–6.

As shown in FIGS. 5–6, the encapsulation device 410 includes a support plate 414 that supports one or more pairs of O-ring devices 416*a* and 416*b* (two pairs of O-ring devices 416*a* and 416*b* are shown). As shown, there are two O-ring assemblies 417*a* and 417*b* in each of the O-ring devices 416*a* and 416*b*. And, each O-ring assembly 417*a* and 417*b* includes an O-ring 450 located around a pair of rollers 452 and a seal plate 454. The two O-rings 450 in each O-ring device 416*a* and 416*b* support the two surfaces 422*a* and 422*b* of the glass sheet 420 and substantially prevent the particles and other contaminants 426 that are generated when the processing device 430*a* and 430*b* processes the edge 424 of the glass sheet 420 from reaching the portion of the glass sheet 420 located on the second side 412*b* of the encapsulation device 410 (see FIG. 6). The encapsulation device 410 may further include one or more pairs of guide wheels (not shown) that are capable of guiding the two surfaces 422*a* and 422*b* of the glass sheet 420 into the gap 418 between each O-ring devices 416*a* and 416*b*.

The processing device 430*a* and 430*b* includes a shroud box 432*a* and 432*b* in which the particles and other contaminants 426 are contained and evacuated from when a finishing device 434 (e.g., grinder 434*a*, polisher 434*b*) processes the edge 424 of the glass sheet 420 (see FIGS. 4 and 6). The processing device 430*a* and 430*b* also includes a vacuum line 436*a* and 436*b* which is connected to the shroud box 432*a* and 432*b* at a strategic location to evacuate the particles and other contaminants 426 (see FIG. 4). The vacuum line 436*a* and 436*b* is also used to evacuate water and other lubricants which aid in the grinding and/or polishing of the edge 424 of the glass sheet 420.

Each O-ring device 416*a* and 416*b* is located in close proximity to where the particles and other contaminants 426 are generated by the turning of the finishing device 434*a* and 434*b* within the processing devices 430*a* and 430*b* (see FIG. 6). And, each O-ring device 416*a* and 416*b* has two O-rings 450 which mechanically seal the glass sheet 420. Each O-ring 450 runs between two rollers 452 at each end and are guided by a set of tracks that are built into the seal plate 454 located between the rollers 452 (see FIG. 5). The seal plate 454 covers the area between the rollers 452 and the O-rings 450 and helps block the particles and contaminants 426. The rollers 452 also help guide the corner of the glass sheet 420 as it enters the gap 418 between the two O-rings 450. The two O-rings 450 are placed perpendicular to the two surfaces 422*a* and 422*b* of the glass sheet 420 and in very close proximity of the edge 428 being processed so that the O-rings 405 contact the glass sheet 420 in a non-quality area (see FIG. 6). It should be noted that the O-rings 450 move with the glass sheet 420 as the glass sheet 420 is moved through the gap 418.

Figure 7:
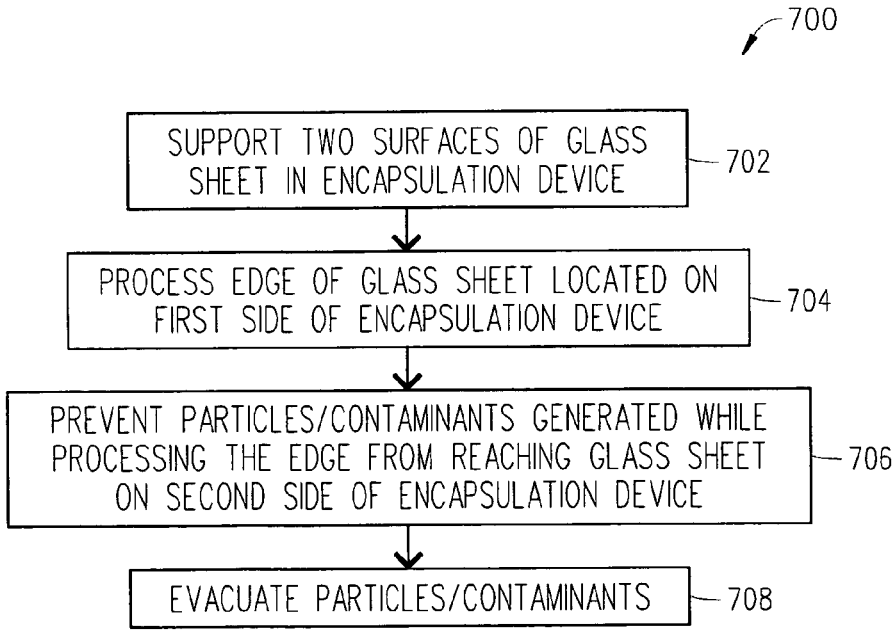
FIG. 7 is a flowchart illustrating the basic steps of a preferred method for using the apparatuses shown in FIGS. 1 and 4 to process an edge of a glass sheet in accordance with the present invention.

Referring to FIG. 7, there is a flowchart illustrating the basic steps of the preferred method 700 for using the apparatuses 100 and 400 shown in FIGS. 1 and 4. For clarity, the method 700 is described below with respect to using apparatus 100 (see FIGS. 1–3). However, it should be understood that the method 700 can also be performed using other apparatuses in accordance with the present invention including apparatus 400 (see FIGS. 4–6). Beginning at step 702, the two surfaces 122*a* and 122*b* of the glass sheet 120 are placed and supported within an encapsulation device 110. At step 704, the edge 124 adjacent to the supported two surfaces of the glass sheet 120 is processed (e.g., grind, polished) by the processing device 130 (see FIGS. 1 and 3). The edge 124 of the glass sheet 120 that is processed is located on a first side 112*a* of the encapsulation device 110. At step 706, the particles and other contaminants 126 generated when the processing device 130 processes the edge 124 of the glass sheet 120 are prevented from reaching the two surfaces 112*a* and 112*b* of the glass sheet 120 located on a second side 112*b* of the encapsulation device 110 (see FIGS. 1 and 3). Lastly at step 708, the particles and other contaminants 126 are evacuated from within the shroud box 132 of the processing device 130.

Following are some advantages and uses of the apparatus 100 and 400 and method 700 of the present invention:

The apparatus 100 and 400 may be configured and adapted to work with the existing equipment in a finishing line.

The apparatus 100 and 400 dramatically reduces the amount of particles/contaminants that are left on the glass sheet which reduces the load on the downstream washing units and eliminates the need to use film coating on the glass sheet. This translates into significant savings by reducing upfront cost of washing equipment, saving operating and maintenance costs and increasing the number of selects that can be shipped to customers.

The apparatus 100 and 400 can be used to grind and/or polish an edge of a liquid crystal display (LCD) glass sheet which can be used in a flat panel display.

The apparatus 100 and 400 can use any number of processing devices including a cutting device, a scribing device, a grinding device and/or a polishing device (for example).

The apparatus 100 and 400 can also straighten a glass sheet if it is originally warped while passing through the gap between the porous plates or O-ring assemblies which helps increase the consistency of the grinding process or other processes.

The glass plate 120 and 420 in the preferred embodiment is a Liquid Crystal Display (LCD) glass plate that was made in accordance with a fusion process described in U.S. Pat. Nos. 3,338,696 and 3,682,609 both of which are incorporated by reference herein. These LCD glass plates are known in the industry as Corning Incorporated Codes 7059 and 1737 sheet glass or EAGLE 2000™ sheet glass.

Although two embodiments of the present invention has been illustrated in the accompanying Drawings and described in the foregoing Detailed Description, it should be understood that the invention is not limited to the embodiments disclosed, but is capable of numerous rearrangements, modifications and substitutions without departing from the spirit of the invention as set forth and defined by the following claims.

What is claimed is:

1. An apparatus for processing an edge of a sheet of material, said apparatus comprising:

an encapsulation device for supporting two surfaces of the material;

a processing device for processing the edge adjacent to the supported two surfaces of the material that is located on a first side of said encapsulation device; and said encapsulation device substantially prevents particles and other contaminants generated when said processing device processes the edge of the material from reaching the two surfaces of the material located on a second side of said encapsulation device, wherein said encapsulation device includes:

a support plate;

a pair of porous plates supported by said support plate and pressurized by air received from said support plate which flows through the porous plates and supports the two surfaces of the material within a gap between the porous plates, wherein the pressurized air emitted from the porous plates substantially prevents particles and other contaminants generated when said processing device processes the edge of the material from reaching the two surfaces of the material located on the second side of said encapsulation device;

and wherein said encapsulation device further includes a pair of guide wheels for guiding the two surfaces of the material within the gap between the porous plates.

2. The apparatus of claim 1, wherein said encapsulation device includes:

a support plate, a pair of O-ring assemblies, supported by said support plate, each O-ring assembly includes:

a pair of rollers;

a seal plate; and an O-ring located around said pair of rollers and a said seal plate, wherein said O-rings support the two surfaces of the material and substantially prevent particles and other contaminants generated when said processing device processes the edge of the material from reaching the two surfaces of the material located on the second side of said encapsulation device.

3. The apparatus of claim 1, wherein said processing device is capable of cutting, scribing, grinding or polishing the edge of the material.

4. The apparatus of claim 1, wherein said processing device includes a shroud box in which the particles and other contaminants are contained and evacuated from while processing the edge of the material.

5. The apparatus of claim 1, wherein said material is a glass sheet.

6. A method for processing an edge of a sheet of material, said method comprising the steps of:

supporting two surfaces of the material within an encapsulation device;

processing the edge adjacent to the supported two surfaces of the material that is located on a first side of said encapsulation device;

preventing particles and other contaminants generated during the processing step from reaching the two surfaces of the material located on a second side of said encapsulation device, wherein said encapsulation device includes:

a support plate;

a pair of porous plates supported by said support plate and pressurized by air received from said support plate which flows through the porous plates and supports the two surfaces of the material within a gap between the porous plates, wherein the pressurized air emitted from the porous-plates substantially prevents particles and other contaminants generated when a processing device processes the edge of the material from reaching the two surfaces of the material located on the second side of said encapsulation device; and wherein said encapsulation device further includes a pair of guide wheels for guiding the two surfaces of the material within the gap between the porous plates.

7. The method of claim 6, further comprising the step of evacuating the particles and other contaminants generated during the processing step.

8. The method of claim 6, wherein said processing step further includes cutting, scribing, grinding or polishing the edge of the material.

9. The method of claim 6, wherein said encapsulation device includes:

a support plate, a pair of O-ring assemblies, supported by said support plate, each O-ring assembly includes:

a pair of rollers;

a seal plate; and an O-ring located around said pair of rollers and a said seal plate, wherein said O-rings support the two surfaces of the material and substantially prevent particles and other contaminants generated when a processing device processes the edge of the material from reaching the two surfaces of the material located on the second side of said encapsulation device.

10. The method of claim 6, wherein said material is a glass sheet.

11. An apparatus for processing an edge of a glass sheet, said apparatus comprising:

a processing device for processing only edges of a glass sheet;

said encapsulation device including:

a support plate;

a pair of porous plates supported by said support plate and pressurized by air received from said support plate which flows through the porous plates and supports two surfaces of the glass sheet within a gap between the porous plates, wherein the pressurized air emitted from the porous plates substantially prevents particles and other contaminants generated when said processing device processes the edge of the glass sheet on a first side of said porous plates from reaching the two surfaces of the glass sheet located on a second side of said porous plates; and wherein said encapsulation device further includes a pair of guide wheels for guiding the two surfaces of the material within the gap between the porous plates.

* * * * *